US009469120B2

(12) United States Patent
Hara et al.

(10) Patent No.: US 9,469,120 B2
(45) Date of Patent: Oct. 18, 2016

(54) DUMMY HEAD AND LIQUID EJECTING APPARATUS

(71) Applicant: SEIKO EPSON CORPORATION, Tokyo (JP)

(72) Inventors: Kazuhiko Hara, Shiojiri (JP); Masahiko Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/970,188

(22) Filed: Dec. 15, 2015

(65) Prior Publication Data

US 2016/0243844 A1 Aug. 25, 2016

(30) Foreign Application Priority Data

Feb. 25, 2015 (JP) ..... 2015-035021

(51) Int. Cl.
*B41J 2/15* (2006.01)
*B41J 2/175* (2006.01)
*B41J 2/165* (2006.01)

(52) U.S. Cl.
CPC ..... *B41J 2/17563* (2013.01); *B41J 2/16505* (2013.01)

(58) Field of Classification Search
CPC ..... B41J 2/145; B41J 2/175; B41J 2/14024; B41J 2/14523
See application file for complete search history.

(56) References Cited

U.S. PATENT DOCUMENTS 5,757,390 A 5/1998 Gragg et al.
7,571,985 B2 * 8/2009 Sanada ..... B41J 2/14233 347/50
8,100,505 B2 * 1/2012 Kuroda ..... B41J 2/1603 347/47
8,480,213 B2 * 7/2013 Akiyama ..... B41J 2/17509 347/85
2007/0200903 A1 8/2007 Takabayashi et al.
2009/0201347 A1 8/2009 Hamano
2012/0075379 A1 3/2012 Murase et al.
2013/0106963 A1 5/2013 Kawase et al.

FOREIGN PATENT DOCUMENTS

| | | |
|---|---|---|
| EP | 0 714 779 | 6/1996 |
| JP | 09-136435 | 5/1997 |
| JP | 2001-277539 | 10/2001 |
| JP | 2003-145786 | 5/2003 |
| JP | 2005 074763 | 3/2005 |
| JP | 2005-074763 | 3/2005 |
| JP | 2007-021937 | 2/2007 |
| JP | 2009-184233 | 8/2009 |
| JP | 2012-030565 | 2/2012 |

OTHER PUBLICATIONS

European Search Report for Application No. 15202436.0 dated Jul. 4, 2016.

* cited by examiner

*Primary Examiner* — Lamson Nguyen
(74) *Attorney, Agent, or Firm* — Workman Nydegger

(57) ABSTRACT

A dummy head is attachable to and detachable from a carriage of a liquid ejecting apparatus including a first route having a supply port through which a liquid can be supplied to a liquid ejecting head in a state of being attached to the carriage, and a second route having a collection port through which the liquid can be collected from the liquid ejecting head. The dummy head has a third route which can be connected to the supply port and the collection port.

8 Claims, 7 Drawing Sheets

DUMMY HEAD AND LIQUID EJECTING APPARATUS

BACKGROUND

1. Technical Field

The present invention relates to a dummy head and a liquid ejecting apparatus.

2. Related Art

In the related art, liquid ejecting apparatuses ejecting a liquid through a nozzle have been used. Among these liquid ejecting apparatuses, a liquid ejecting apparatus including an attachable/detachable liquid ejecting head is disclosed.

For example, JP-A-2005-74763 discloses an ink jet recording apparatus (liquid ejecting apparatus) including an attachable/detachable line head (liquid ejecting head).

On the other hand, in recent years, the liquid ejecting apparatuses have used various types of liquids (inks). For example, a liquid ejecting apparatus including a channel configuration which can circulate a liquid has been used in order to prevent a disadvantage occurring due to sediment of high specific gravity components in the liquid (pigments in the ink).

However, although the liquid ejecting apparatus in the related art which includes the attachable/detachable liquid ejecting head can generally circulate the liquid in a state where the liquid ejecting head is attached thereto, the liquid ejecting apparatus cannot circulate the liquid in a state where the liquid ejecting head is detached therefrom.

SUMMARY

An advantage of some aspects of the invention is to provide a liquid ejecting apparatus which includes an attachable/detachable liquid ejecting head, and which can circulate a liquid even in a state where the liquid ejecting head is detached from the liquid ejecting apparatus which can circulate the liquid.

According to an aspect of the invention, there is provided a dummy head attachable to and detachable from an attachment/detachment position of a liquid ejecting head in a carriage of a liquid ejecting apparatus including the carriage which detachably holds a liquid ejecting head for ejecting a liquid onto a medium through a nozzle, a first route having a supply port through which the liquid can be supplied to the liquid ejecting head in a state of being attached to the carriage, and a second route having a collection port through which the liquid can be collected from the liquid ejecting head in the state of being attached to the carriage. The dummy head has a third route that can be connected to the supply port and the collection port.

In this case, the dummy head is attached to the attachment/detachment position of the liquid ejecting head in the carriage, thereby enabling the liquid to be circulated in the first route, the second route, and the third route. Therefore, even when the liquid ejecting head is detached therefrom, the dummy head is attached thereto, thereby enabling the liquid to be circulated in a channel (the first route, the second route, and the third route).

The "dummy head" means a configuration member which is attachable to and detachable from the attachment/detachment position of the liquid ejecting head in place of the liquid ejecting head.

In addition, the "carriage" means a holding unit that holds the liquid ejecting head, and is not particularly limited as long as the carriage can hold (attach, mount, install, or fix) the liquid ejecting head.

In the dummy head according to the aspect of the invention, the third may include a gas-liquid separating unit.

Here, the "gas-liquid separating unit" means a configuration member through which the liquid cannot pass but gas can pass. For example, the gas-liquid separating unit corresponds to a gas-liquid separating membrane or a float valve.

In this case, the third route includes the gas-liquid separating unit. Accordingly, the liquid channel can be filled with the liquid while the gas such as air is discharged via the gas-liquid separating unit.

In the dummy head according to the aspect of the invention, the liquid ejecting apparatus may include a cap which caps a forming portion of the nozzle in a state where the liquid ejecting head is attached to the carriage. The dummy head may include a contact portion which can come into contact with the cap in a state where the dummy head is attached to the carriage.

In this case, the dummy head includes the contact portion which can come into contact with the cap in a state where the dummy head is attached to the carriage. Therefore, similarly to a state where the liquid ejecting head is attached to the carriage, in a state where the dummy head is attached to the carriage, the dummy head can be fixed to the liquid ejecting apparatus by being brought into a capped state.

According to another aspect of the invention, there is provided a liquid ejecting apparatus including a carriage that detachably holds a liquid ejecting head for ejecting a liquid onto a medium through a nozzle, a first route that has a supply port through which the liquid to be accommodated in a liquid supply source can be supplied to the liquid ejecting head in a state of being attached to the carriage, and a second route that has a collection port through which the liquid can be collected from the liquid ejecting head in the state of being attached to the carriage. In a state where the dummy head according to the aspect of the invention is attached to the carriage, the liquid can be circulated in the first route, the second route, and the third route.

In this case, the dummy head is attached to the attachment/detachment position of the liquid ejecting head in the carriage, thereby enabling the liquid to be circulated in the first route, the second route, and the third route. Therefore, even when the liquid ejecting head is detached therefrom, the dummy head is attached thereto, thereby enabling the liquid to be circulated in the channel.

The liquid ejecting apparatus according to the aspect of the invention may further include fourth route that connects the first route and the second route to each other. When the liquid is ejected onto the medium by using the liquid ejecting head attached to the carriage, the liquid may be circulated in the first route, the second route, and the fourth route.

When the liquid is ejected onto the medium, if the liquid is circulated in the channel inside the liquid ejecting head, the liquid is unstably supplied to the nozzle in some cases.

On the other hand, in this case, the liquid ejecting apparatus includes the fourth route that connects the first route and the second route to each other. When the liquid is ejected onto the medium by using the liquid ejecting head attached to the carriage, the liquid may be circulated in the first route, the second route, and the fourth route, without using an ink channel inside the liquid ejecting head. Therefore, the liquid can be circulated in the liquid channel while the liquid is controlled so as to be stably supplied to the nozzle.

In the liquid ejecting apparatus according to the aspect of the invention, the liquid ejecting head disposed at multiple locations may be attachable to and detachable from the carriage. The first route and the second route may be disposed for each of the multiple liquid ejecting heads. In a state where the liquid ejecting head and the dummy head are attached to the carriage, when the liquid is ejected onto the medium by using the liquid ejecting head attached to the carriage, the liquid may be circulated in the first route, the second route, and the third route which correspond to the dummy head attached to the carriage.

In this case, the multiple liquid ejecting head is attachable to and detachable from the carriage. The first route and the second route are disposed for each of the multiple liquid ejecting heads. Then, in a state where the liquid ejecting head and the dummy head are attached to the carriage, when the liquid is ejected onto the medium by using the liquid ejecting head attached to the carriage, the liquid can be circulated in the first route, the second route, and the third route which correspond to the dummy head attached to the carriage. That is, the liquid can be ejected onto the medium, while the liquid can be circulated in the liquid channel to which the dummy head is attached. Therefore, the liquid can be efficiently ejected and circulated.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

FIGS. 1 to 6

Hereinafter, a recording apparatus 1 serving as a liquid ejecting apparatus according to Embodiment 1 of the invention will be described in detail with reference to the accompanying drawings.

First, an overview of the recording apparatus 1 according to the present embodiment will be described. The recording apparatus 1 is an ink jet recording apparatus which discharges (ejects) an ink serving as one example of liquids through a recording head 2 serving as a liquid ejecting head so as to perform recording on a medium.

Figure 1:
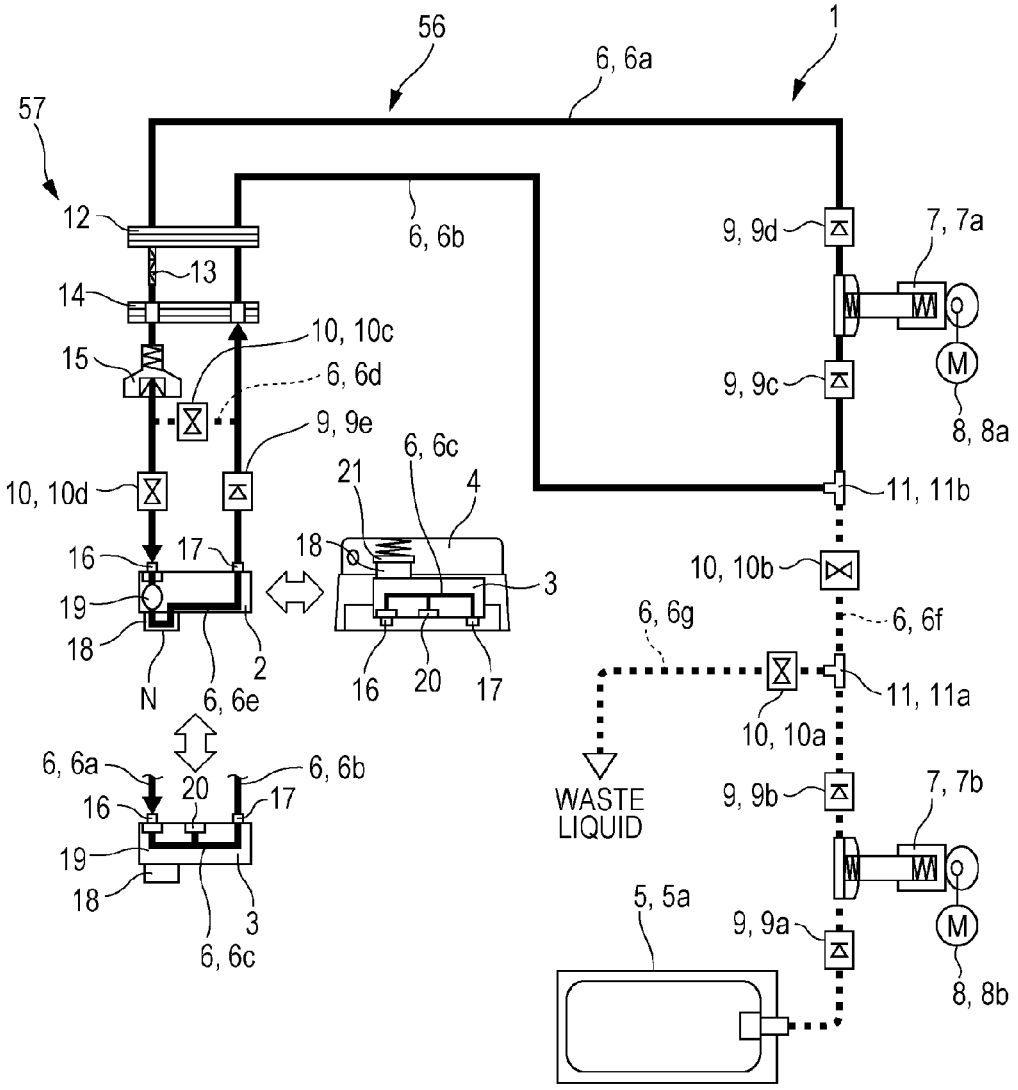
FIG. 1 is a schematic view illustrating a recording apparatus according to Embodiment 1 of the invention.

FIG. 1 illustrates a schematic view of the recording apparatus 1 according to the embodiment.

The recording apparatus 1 according to the embodiment is a liquid ejecting apparatus which includes the recording head 2 which is attachable and detachable, and which can circulate the ink in an ink channel 6 in an ink circulating unit 56.

The recording apparatus 1 according to the embodiment can perform recording on a medium transported by a transport unit (not illustrated) in such a way that a carriage 57 to which the recording head 2 capable of discharging the ink is attached reciprocates in a direction intersecting a transport direction of the medium.

The recording head 2 serving as a liquid ejecting head is detachably attached to the carriage 57 according to the embodiment. However, the "carriage" described herein means a holding unit which can hold (attach, mount, install, or fix) the liquid ejecting head, and is not particularly limited as long as the liquid ejecting head can be held.

As illustrated in FIG. 1, the recording apparatus 1 according to the embodiment can supply the ink from an ink cartridge 5*a* serving as a liquid supply source 5 to an ink circulating unit 56 via a supply route 6*f* serving as the ink channel 6 by using a supply pump 7*b* serving as a pump 7. The supply route 6*f* has a check valve 9 (check valves 9*a* and 9*b*) for preventing the ink from reversely flowing, a valve 10 (valve 10*b*) for regulating a flow rate of the ink, and a trifurcating portion 11 (trifurcating portion 11*a*) for distributing the ink flow. In other words, the supply route 6*f* is the ink channel 6 extending from the ink cartridge 5*a* to the trifurcating portion 11*b*.

The recording apparatus 1 according to the embodiment includes a discharge route 6*g* serving as the ink channel 6 which connects the trifurcating portion 11*a* and a waste liquid bottle (not illustrated). A valve 10*a* is disposed in the discharge route 6*g*.

As the ink channel 6, the ink circulating unit 56 has a first route 6*a* whose one end has a supply port 30 (refer to FIG. 4) and which can supply the ink to the recording head 2, and a second route 6*b* whose one end has a collection port 31 (refer to FIG. 4) and which can collect the ink from the recording head 2. Then, the other end of the first route 6*a* and the other end of the second route 6*b* are connected to each other in the trifurcating portion 11*b*.

The ink circulating unit 56 has a circulating pump 7*a* serving as the pump 7 which applies force for circulating the ink, check valves 9*c*, 9*d*, and 9*e*, a valve 10*d*, a coupler 12 formed in the carriage 57, a static mixer 13, an ink channel member 14 disposed in the carriage 57, and a buffer 15 which can temporarily hold the ink.

Here, the static mixer 13 is configured to include a cylindrical housing (not illustrated) and multiple partition plates (not illustrated) serving as elements extending inside the cylindrical housing in an axial direction of the cylindrical housing, and has a structure in which the extending partition plates are twisted reversely to each other. Then, each time the ink passes through the respective partition plates, the ink passing therethrough is newly twisted and split, thereby uniformly mixing the ink passing therethrough.

Here, a region from a downstream side of the coupler 12 in a flowing direction of the ink in the first route 6*a* in FIG. 1 to an upstream side of the coupler 12 in a flowing direction of the ink in the second route 6*b* in FIG. 1 corresponds to the carriage 57. Then, the recording head 2 is attachable to and detachable from the carriage 57.

The recording head 2 has a connection portion 16 which can be connected to the supply port 30, and a connection portion 17 which can be connected to the collection port 31.

In addition, the recording head 2 has a protrusion portion 18 having a nozzle N capable of discharging the ink, an ink route 6*e* configuring the ink channel 6 from the connection portion 16 to the connection portion 17 through the protrusion portion 18, and a pressure regulating unit 19 (to be described in detail later) disposed in the ink route 6*e*.

This configuration enables the recording apparatus 1 according to the embodiment to circulate the ink in the first route 6*a*, the ink route 6*e*, and the second route 6*b*, in a state where the recording head 2 is attached to the carriage 57.

As described above, the recording apparatus 1 according to the embodiment is configured to perform recording by reciprocating scanning of the recording head 2. However, a configuration may be adopted which includes a so-called line head in which the nozzle N for discharging the ink is disposed at multiple locations in a direction intersecting a transport direction of the medium.

Here, the "line head" is a recording head used for a recording apparatus which is disposed so that a region of the nozzle N formed in the intersecting direction can entirely cover the intersecting direction, and which forms an image by fixing one and moving the other one between the recording head and the medium. The region of the nozzle N in the intersecting direction of the line head may not entirely cover the intersecting direction of all media to which the recording apparatus corresponds.

In addition, the recording apparatus 1 according to the embodiment is configured to perform recording by transporting (moving) the medium to the recording head 2. However, a configuration may be adopted in which the recording head 2 is moved to the medium (for example, a so-called flatbed type), or a configuration may be adopted in which both the medium and the recording head 2 are moved.

In the recording apparatus 1 according to the embodiment, in place of the recording head 2, a dummy head 3 having a housing similar to the housing of the recording head 2 can be attached to the carriage 57. Here, the "dummy head" means a configuration member which is attachable to and detachable from an attachment/detachment position of the liquid ejecting head in place of the liquid ejecting head.

Similarly to the recording head 2, the dummy head 3 according to the embodiment has the connection portion 16 which can be connected to the supply port 30, and the connection portion 17 which can be connected to the collection port 31. The, the dummy head 3 has a third route 6*c* configuring the ink channel 6 from the connection portion 16 to the connection portion 17.

FIG. 1 illustrates not only a state where the dummy head 3 is attached to the carriage 57 in place of the recording head 2, but also a state where the dummy head 3 is accommodated in a storage box 4, that is, a state where the dummy head 3 is accommodated vertically opposite to the installed posture in the carriage 57. The storage box 4 will be described in detail later.

The dummy head 3 according to the embodiment is attached to the carriage 57, thereby enabling the ink to be circulated in the first route 6*a*, the third route 6*c*, and the second route 6*b*.

As described above, the recording apparatus 1 according to the embodiment includes the carriage 57 which detachably holds the recording head 2 for ejecting the ink onto the medium through the nozzle N, the first route 6*a* having the supply port 30 through which the ink to be accommodated in the liquid supply source 5 can be supplied to the recording head 2 in a state of being attached to the carriage 57, and the second route 6*b* having the collection port 31 through which the ink can be collected from the recording head 2 in the state of being attached to the carriage 57.

The dummy head 3 according to the embodiment is attachable to and detachable from the attachment/detachment position of the recording head 2 in the carriage 57 of the recording apparatus 1, and has the third route 6*c* which can be connected to the supply port 30 and the collection port 31. The dummy head 3 is attached to the carriage 57, thereby enabling the ink to be circulated in the first route 6*a*, the second route 6*b*, and the third route 6*c*.

In other words, the recording apparatus 1 according to the embodiment can circulate the ink in the first route 6*a*, the second route 6*b*, and the third route 6*c*, in a state where the dummy head 3 according to the embodiment is attached to the carriage 57.

Therefore, even in a state where the recording head 2 is detached from the recording apparatus 1, the ink can be circulated in the channel 6 (the first route 6*a*, the second route 6*b*, and the third route 6*c*) by attaching the dummy head 3 thereto.

As illustrated in FIG. 1, the recording apparatus 1 according to the embodiment includes a fourth route 6*d* which connects the first route 6*a* and the second route 6*b* to each other, as the ink channel 6. When the ink is ejected onto the medium by using the recording head 2 attached to the carriage 57, the recording apparatus 1 can circulate the ink in the first route 6*a*, the second route 6*b*, and the fourth route 6*d*.

During recording, that is, when the ink is ejected onto the medium, if the ink is circulated in the ink channel (ink route 6*e*) inside the recording head 2, the ink is unstably supplied to the nozzle N in some cases.

On the other hand, the recording apparatus 1 according to the embodiment includes the fourth route 6*d* which connects the first route 6*a* and the second route 6*b* to each other, as the ink channel 6. That is, when the ink is ejected onto the medium by using the recording head 2 attached to the carriage 57, the ink can be circulated in the first route 6*a*, the second route 6*b*, and the fourth route 6*d* without using the ink channel 6 (ink route 6*e*) inside the recording head 2. Therefore, the ink can be circulated in the channel 6 (the first route 6*a*, the second route 6*b*, and the fourth route 6*d*), while the ink is controlled so as to be stably supplied to the nozzle N.

Multiple recording heads 2 are detachably attached to the carriage 57 according to the embodiment. Then, the ink circulating unit 56 (the first route 6*a* and the second route 6*b*) is disposed for each of the multiple recording heads 2. The recording head 2 and the dummy head 3 can be mixedly attached to the carriage 57. For example, recording can be performed by attaching the ink cartridge 5*a* containing cyan, magenta, yellow, black, and white inks to the carriage 57 and attaching the recording head 2 capable of ejecting the cyan, magenta, yellow, black, and white inks to the carriage 57. On the other hand, recording can also be performed using the cyan, magenta, yellow, and black inks by attaching the recording head 2 capable of ejecting the cyan, magenta, yellow, and black inks to the carriage 57 and attaching the dummy head 3 to the carriage 57 in place of the recording head 2 capable of ejecting the white ink.

In a state where the recording head 2 and the dummy head 3 are mixedly attached to the carriage 57, when the ink is ejected onto the medium by using the recording head 2 attached to the carriage 57, the ink can be circulated in the first route 6*a*, the second route 6*b*, and the third route 6*c* which correspond to the dummy head 3 attached to the carriage 57. That is, in the above-described example in which the dummy head 3 is attached in place of the recording head 2 capable of ejecting the white ink, the ink can be circulated in the first route 6*a*, the second route 6*b*, and the third route 6*c* in the ink route 6 of the white ink.

In this way, the ink can be ejected onto the medium while the ink is circulated in the ink channel 6 to which the dummy head 3 is attached. Therefore, the ink can be efficiently ejected and circulated.

In the above-described example in which the dummy head 3 is attached in place of the recording head 2 capable of ejecting the white ink, the ink may be circulated in the first route 6*a*, the second route 6*b*, and the fourth route 6*d* in the respective ink routes 6 of the cyan, magenta, yellow, and black inks at the same time.

Next, an electrical configuration in the recording apparatus 1 according to the embodiment will be described.

Figure 2:
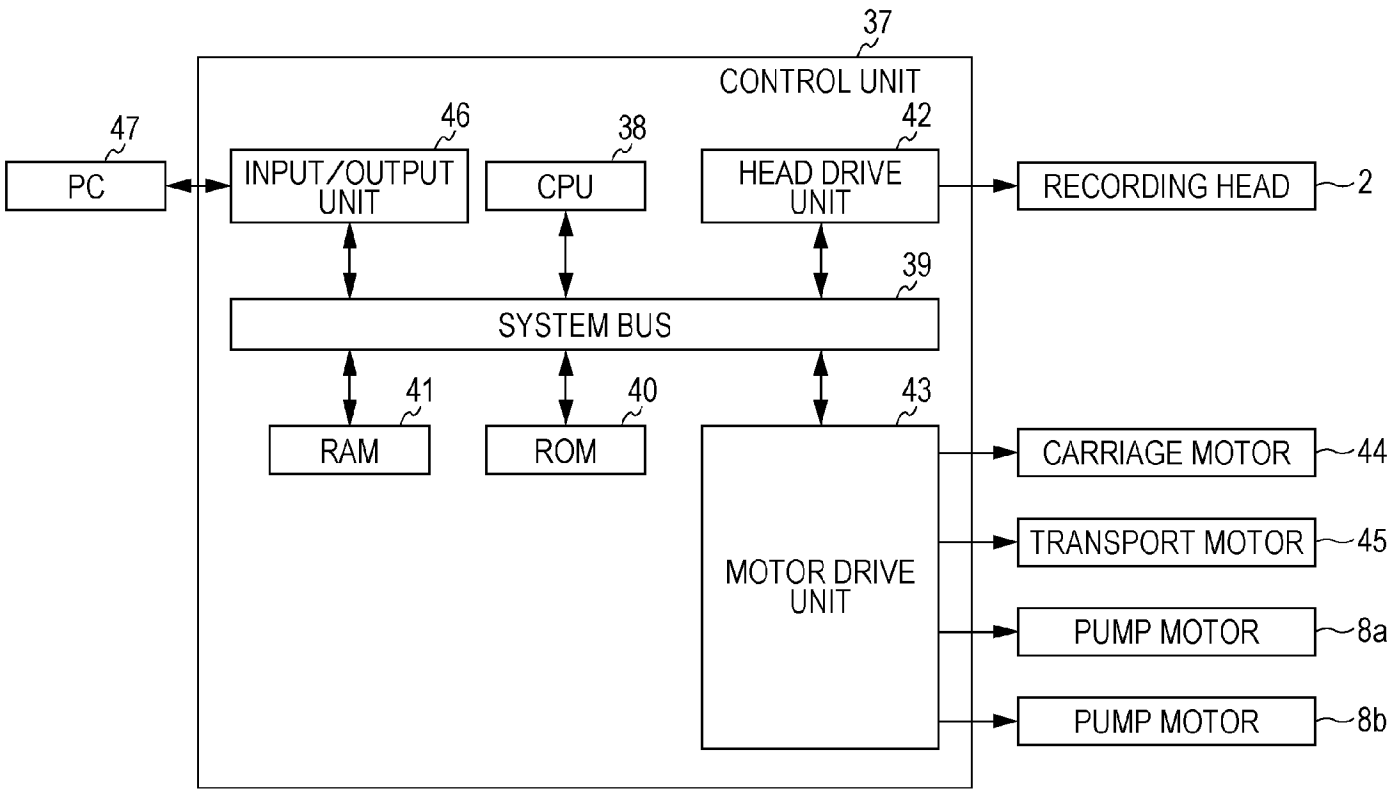
FIG. 2 is a block diagram illustrating the recording apparatus according to Embodiment 1 of the invention.

FIG. 2 is a block diagram of the recording apparatus 1 according to the embodiment.

A control unit 37 has a CPU 38 which controls the overall recording apparatus 1. The CPU 38 is connected via a system bus 39 to ROM 40 which stores various control programs such as a maintenance sequence executed by the CPU 38 (ink circulation in the ink circulating unit 56), and to RAM 41 which can temporarily store data.

The CPU 38 is connected via the system bus 39 to a head drive unit 42 for diving the recording head 2.

The CPU 38 is connected via the system bus 39 to a motor drive unit 43 for driving a carriage motor 44, a transport motor 45, a pump motor 8*a*, and a pump motor 8*b*. Here, the carriage motor 44 is a motor for moving the carriage 57. The transport motor 45 is a motor for driving a transport roller of a transport unit (not illustrated). The pump motors 8*a* and 8*b* are motor for respectively driving the circulating pump 7*a* and the supply pump 7*b*.

Furthermore, the CPU 38 is connected via the system bus 39 to an input/output unit 46, and the input/output unit 46 is connected to a PC 47 for transmitting and receiving data and a signal of recording data.

This configuration enables the control unit 37 according to the embodiment to perform drive control on the overall recording apparatus 1. The recording head 2 and the dummy head 3 has a chip (electric circuit) on which various information items are written. The control unit 37 causes a reading mechanism (not illustrated) to read the information written on the chip, and can read which one between the recording head 2 and the dummy head 3 is attached to the carriage 57, or a type of the recording head 2. Then, in accordance with the read information, the control unit 37 can determine whether to circulate the ink in the first route 6*a*, the second route 6*b*, and the third route 6*c*, or whether to circulate the ink in the first route 6*a*, the second route 6*b*, and the fourth route 6*d*.

Employing the recording apparatus having a configuration according to the embodiment can further decrease an ink discharge amount, compared to a recording apparatus having other configurations which can circulate the ink.

Hereinafter, a decrease in the ink discharge amount will be described with reference to FIGS. 3A and 3B.

Figure 3B:
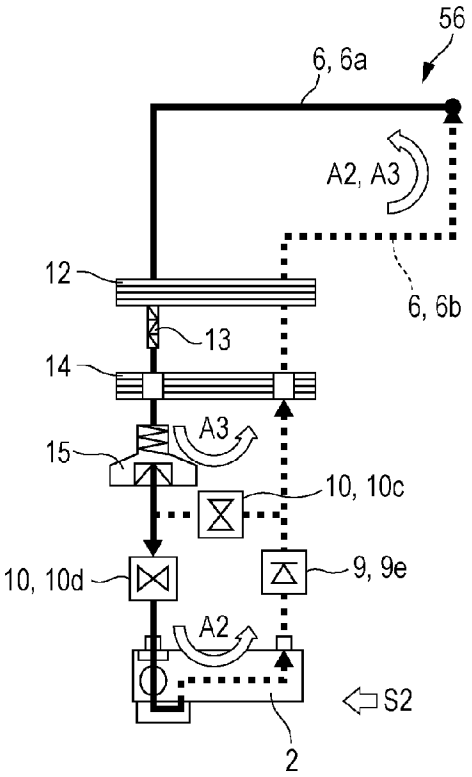
FIGS. 3A and 3B are schematic views illustrating a recording apparatus according to a reference example and the recording apparatus according to Embodiment 1 of the invention.
Figure 3A:
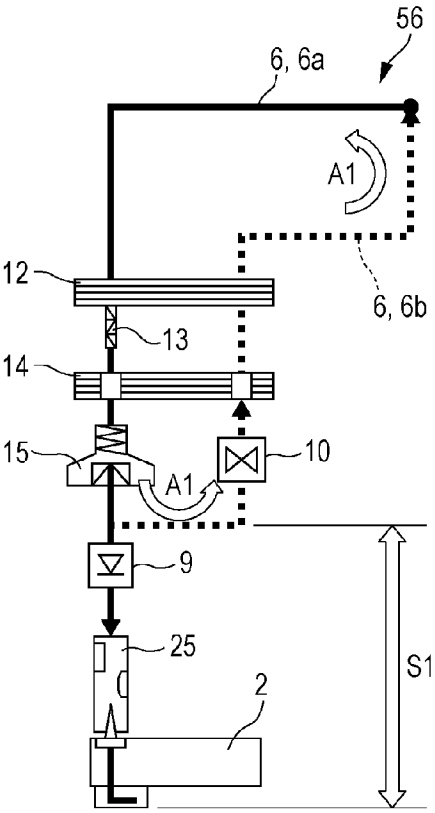

FIG. 3A is a schematic view illustrating the ink circulating unit 56 of the recording apparatus 1 according to a reference example in which the ink can be circulated in the ink channel. On the other hand, FIG. 3B is a schematic view illustrating the ink circulating unit 56 of the recording apparatus 1 according to the embodiment.

As illustrated in FIG. 3A, in the recording apparatus 1 according to the reference example in which the ink can be circulated in the ink channel as illustrated by an arrow A1, the first route 6*a* and the second route 6*b* are directly connected to each other, and the ink inside the recording head 2 cannot be circulated. Consequently, the ink in a region S1 on the further downstream side from a connection portion between the first route 6*a* and the second route 6*b* in a direction in which the ink is supplied to the recording head 2 is discharged without any change. That is, it is necessary to discharge the ink remaining inside the check valve 9, the pressure regulating unit 25, and the recording head 2, in addition to the ink in the ink channel 6 of the region S1. For example, a total amount of the ink in the region S1 is approximately 3 grams.

On the other hand, as illustrated in FIG. 3B, in the recording apparatus 1 according to the embodiment in which the ink can be circulated in the ink channel as illustrated by arrows A2 and A3, only the ink remaining inside the recording head 2 (in a region S2) may be sufficiently discharged. For example, a total amount of the ink in the region S2 is approximately 0.2 grams.

In this way, employing the recording apparatus having the configuration according to the embodiment can more considerably decrease an ink discharge amount, compared to a recording apparatus having other configurations which can circulate the ink.

In other words, the recording apparatus 1 according to the embodiment is used so as to enable a user to perform dummy head attaching by which the dummy head 3 having the third route 6*c* which can be connected to the supply port 30 and the collection port 31 is attached to the carriage 57, circulating unit filling by which the first route 6*a* and the second route 6*b* are filled with the ink via the third route 6*c*, liquid ejecting head attaching by which the recording head 2 is attached to the carriage 57 in place of the dummy head 3, and head filling by which the inside of the recording head 2 is filled with the ink.

In this manner, the inside of the recording head 2 is filled with the ink, thereby enabling the recording head 2 to be efficiently filled with the ink.

Next, an attachment unit 26 of the recording head 2 and the dummy head 3 in the carriage 57 of the recording apparatus 1 according to the embodiment will be described.

Figure 4:
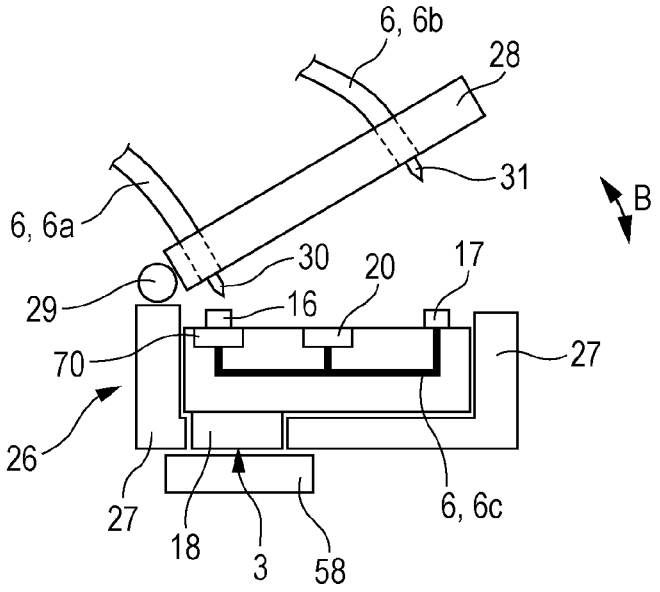
FIG. 4 is a schematic view illustrating an attachment unit of a recording head and a dummy head in a carriage of the recording apparatus according to Embodiment 1 of the invention.

FIG. 4 is a schematic view illustrating the attachment unit 26 of the recording head 2 and the dummy head 3 in the carriage 57 of the recording apparatus 1 according to the embodiment. FIG. 4 illustrates a view when the dummy head 3 is attached to the attachment unit 26. However, as described above, each housing of the recording head 2 and the dummy head 3 has the similar configuration. Accordingly, similarly, the recording head 2 can be attached to the attachment unit 26.

The attachment unit 26 according to the embodiment has a base body 27 in which the recording head 2 and the dummy head 3 can be installed, and a lid 28 including the supply port 30 of the first route 6*a* and the collection port 31 of the second route 6*b*. Then, a configuration is adopted in which the lid 28 is pivotally movable from or to the base body 27 via a hinge portion 29 in a pivotal movement direction B. This configuration enables the attachment unit 26 according to the embodiment to reliably fix the recording head 2 and the dummy head 3.

Both the supply port 30 and the collection port 31 according to the embodiment have a needle-shaped structure which can pierce the connection portions 16 and 17 for connection. However, the supply port 30, the collection port 31, and the connection portions 16 and 17 are not limited to this configuration.

Here, as illustrated in FIG. 4, in the dummy head 3 according to the embodiment, the third route 6*c* includes a gas-liquid separating unit 20 formed of a gas-liquid separating membrane which is located at an upper side position in a state where the dummy head 3 is attached to the carriage 57.

Here, the "gas-liquid separating unit" means a configuration member through which liquid cannot pass but gas can pass. For example, in addition to the gas-liquid separating membrane according to the embodiment, the "gas-liquid separating unit" includes a float valve which closes an air outlet disposed above an accommodation chamber by ascending with buoyance if the ink fills the inside of the accommodation chamber disposed in the third route 6*c*. For example, as a method of separating the liquid and the gas from each other, a method may be employed in which the gas-liquid separating membrane and the ink are caused to react so as to prevent the ink from leaking from the gas-liquid separating membrane. However, the method is not particularly limited.

In this way, in the dummy head 3 according to the embodiment, the third route 6*c* includes the gas-liquid separating unit 20. Therefore, the ink channel 6 can be filled with the ink while the gas such as air is discharged through the gas-liquid separating unit 20.

The third route 6*c* may include a filter which can capture foreign substances or bubbles present in the ink.

The recording apparatus 1 according to the embodiment includes a cap 58 which caps the protrusion portion 18 serving as a forming portion of the nozzle N in a state where the recording head 2 is attached to the carriage 57. Then, as described above, each housing of the recording head 2 and the dummy head 3 has the similar configuration. Therefore, as illustrated in FIG. 4, the cap 58 can cap the protrusion portion 18 of the dummy head 3 in a state where the dummy head 3 is attached to the carriage 57. In other words, the dummy head 3 includes the protrusion portion 18 serving as a contact portion which can come into contact with the cap 58 in a state where the dummy head 3 is attached to the carriage 57. Therefore, in a state where the dummy head 3 is attached to the carriage 57, similarly to a state where the recording head 2 is attached to the carriage 57, the dummy head 3 can be brought into a state of being capped with the cap 58 in the recording apparatus 1.

Next, the storage box 4 which can accommodate the dummy head 3 and the recording head 2 according to the embodiment will be described.

Figure 5:
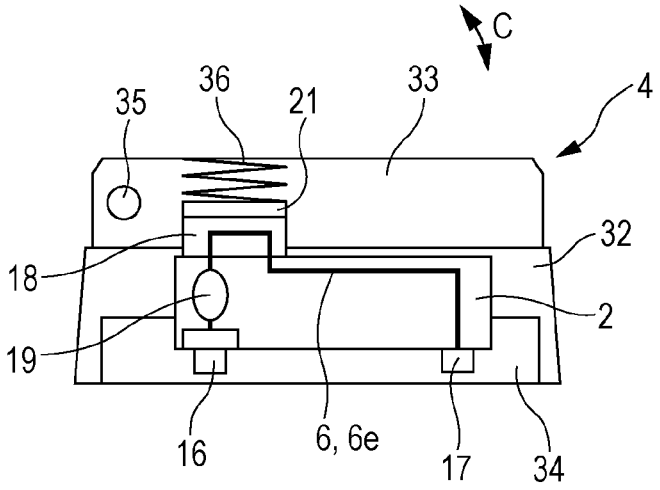
FIG. 5 is a schematic view illustrating a storage box of a liquid ejecting head of the recording apparatus according to Embodiment 1 of the invention.

FIG. 5 is a schematic view illustrating the storage box 4 which can accommodate the dummy head 3 and the recording head 2 according to the embodiment. FIG. 5 illustrates a state where the recording head 2 is accommodated in the storage box 4 according to the embodiment. However, as illustrated in FIG. 1, the dummy head 3 can also be accommodated in the storage box 4.

The storage box 4 according to the embodiment has a base body 32 including an installation portion 34 in which the dummy head 3 and the recording head 2 can be installed, and a lid 33 having a biasing portion including an elastic member 36 which can bias the dummy head 3 and the recording head 2 against the base body 32 and a contact portion 21 which comes into contact with the protrusion portion 18. Then, the lid 33 is configured to be pivotally movable from or to the base body 32 in a pivotal movement direction C by turning around a rotary shaft 35 serving as a pivot. This configuration enables the storage box 4 according to the embodiment to reliably fix the recording head 2 and the dummy head 3.

When the ink contains high specific gravity components, that is, when the ink contains solid components such as pigments having higher density than a solvent, if the recording head 2 is attached to the carriage 57 for a long period of time, the high specific gravity components contained in the ink in the recording head 2 are turned into sediment in some cases. That is, the density is distributed to the ink components accumulated inside the recording head 2 in some cases.

Here, as illustrated in FIG. 5, the storage box 4 according to the embodiment adopts a configuration in which the recording head 2 can be accommodated vertically opposite to the installed posture in the carriage 57. Therefore, even when the recording head 2 is neglected for a long period of time while being accommodated in the storage box 4 according to the embodiment, the recording head 2 is attached to the carriage 57 again, thereby allowing the recording head 2 to adopt a posture which is vertically opposite to the posture adopted when being accommodated in the storage box 4. In this manner, it is possible to improve the density distribution of the ink components accumulated inside the recording head 2, which occurs when the recording head 2 is accommodated in the storage box 4. In the posture adopted when the recording head 2 is accommodated in the storage box 4, the nozzle N is located above. Accordingly, the high specific gravity components are not turned into sediment on the nozzle N side. Therefore, it is possible to prevent poor ejecting caused by clogging.

Next, the pressure regulating unit 19 according to the embodiment will be described.

Figure 6:
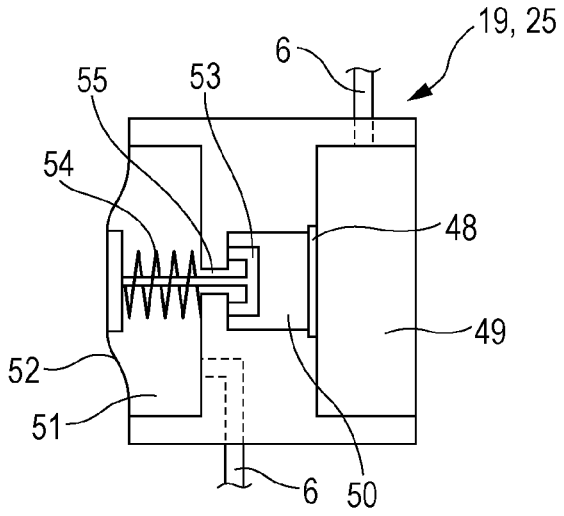
FIG. 6 is a schematic view illustrating a pressure regulating unit of the recording apparatus according to Embodiment 1 of the invention.

FIG. 6 is a schematic view illustrating the pressure regulating unit 19 according to the embodiment.

The pressure regulating unit 25 illustrated in FIG. 3A has the similar configuration.

The pressure regulating unit 19 according to the embodiment includes a filter chamber 49 and a supply chamber 50 which are partitioned by a filter 48. Furthermore, the pressure regulating unit 19 includes a pressure chamber 51 which communicates with the supply chamber 50 via a communication hole 55, a valve body 53 which is disposed between the pressure chamber 51 and the supply chamber 50, and a biasing member 54 which biases the valve body 53 in a valve closing direction. That is, the valve body 53 is inserted into the communication hole 55, and the valve body 53 biased by the biasing member 54 is disposed so as to close the communication hole 55.

The pressure chamber 51 is configured so that a wall surface thereof partially includes a diaphragm 52 which can be bent and deformed along a biasing direction of the biasing member 54. Whereas an outer surface side (left surface side in FIG. 6) of the diaphragm 52 receives atmospheric pressure, an inner surface side thereof (right surface side in FIG. 6) receives pressure from the ink inside the pressure chamber 51. Therefore, the diaphragm 52 is bent and deformed in response to a change in differential pressure between the pressure inside the pressure chamber 51 and the pressure received on the outer surface side.

The supply chamber 50 is held in a state of being pressurized by the pressurized ink supplied from the liquid supply source 5. Then, if the differential pressure between the pressure inside the pressure chamber 51 and the pressure received on the outer surface side is lower than predetermined pressure, biasing force of the biasing member 54 switches the valve body 53 from a state of regulating the communication between the pressure chamber 51 and the supply chamber 50 to a state of allowing the communication between the pressure chamber 51 and the supply chamber 50. Furthermore, if the differential pressure between the pressure inside the pressure chamber 51 and the pressure received on the outer surface side reaches the predetermined pressure, the valve body 53 regulates the communication between the pressure chamber 51 and the supply chamber 50. In this manner, in order to regulate the pressure inside the recording head 2 serving as back pressure of the nozzle N, the pressure regulating unit 19 regulates the pressure of the ink to be supplied to the recording head 2 via the ink channel 6.

Embodiment 2

FIG. 7

Next, the recording apparatus according to Embodiment 2 of the invention will be described.

Figure 7:
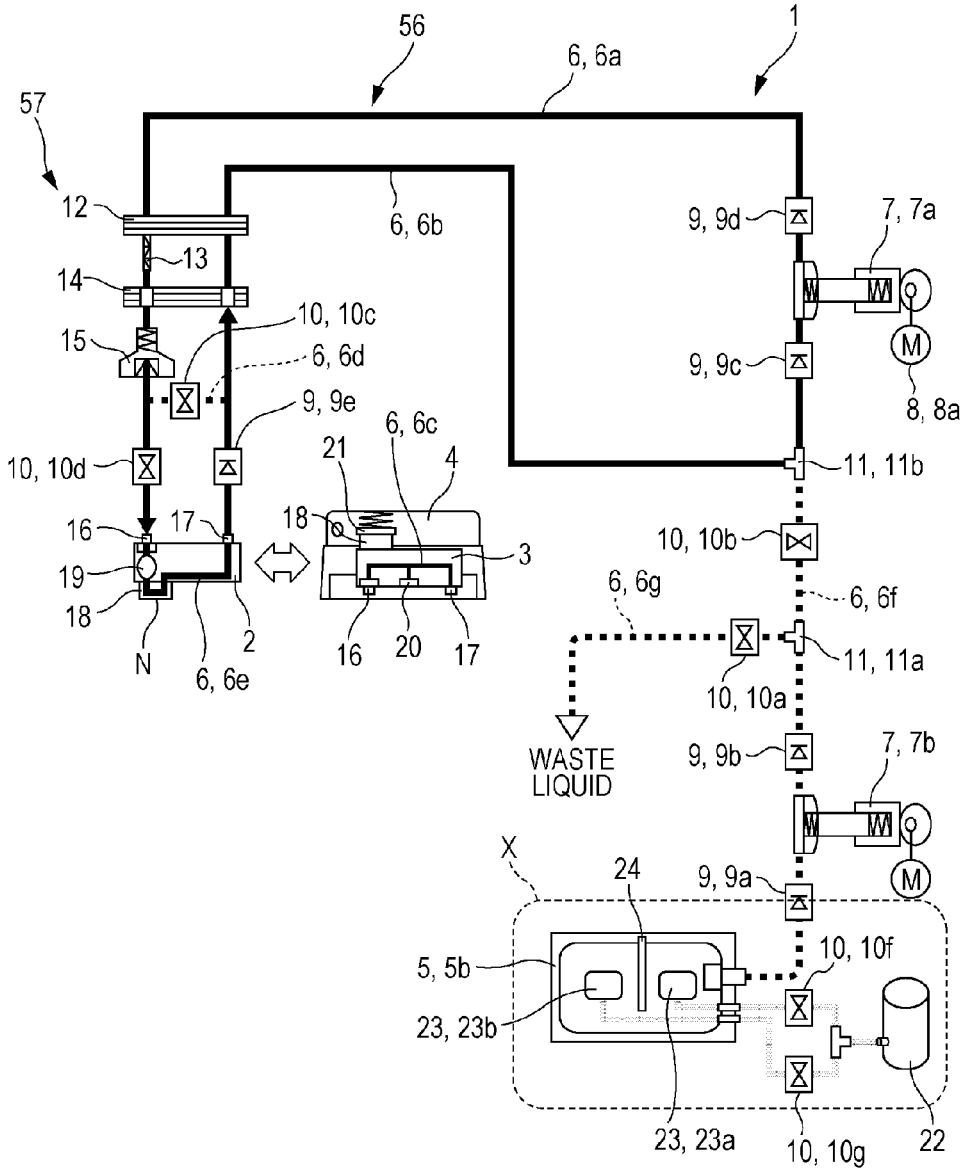
FIG. 7 is a schematic view illustrating a recording apparatus according to Embodiment 2 of the invention.

FIG. 7 is a schematic view illustrating the recording apparatus 1 according to the embodiment, and is a view corresponding to FIG. 1 in Embodiment 1. The same reference numerals will be given to configuration members which are common to those in Embodiment 1 described above, and detailed description will be omitted.

The recording apparatus 1 according to the embodiment is different from the recording apparatus 1 according to Embodiment 1 in only a configuration of a section illustrated by the reference numeral X in FIG. 7.

The recording apparatus 1 according to the embodiment includes an ink cartridge 5*b* having a barrier forming plate 24 and two air bags 23 (air bags 23*a* and 23*b*), as the liquid supply source 5. Then, a configuration is adopted in which valves 10*f* and 10*g* regulate gas supplied from the air pump 22 so as to regulate the amount of the gas of the air bags 23*a* and 23*b* (so as to inflate the air bags 23*a* and 23*b* alternately). In this manner, the ink inside the ink cartridge 5*b* is stirred.

Embodiment 3

FIG. 8

Next, the recording apparatus according to Embodiment 3 of the invention will be described.

Figure 8:
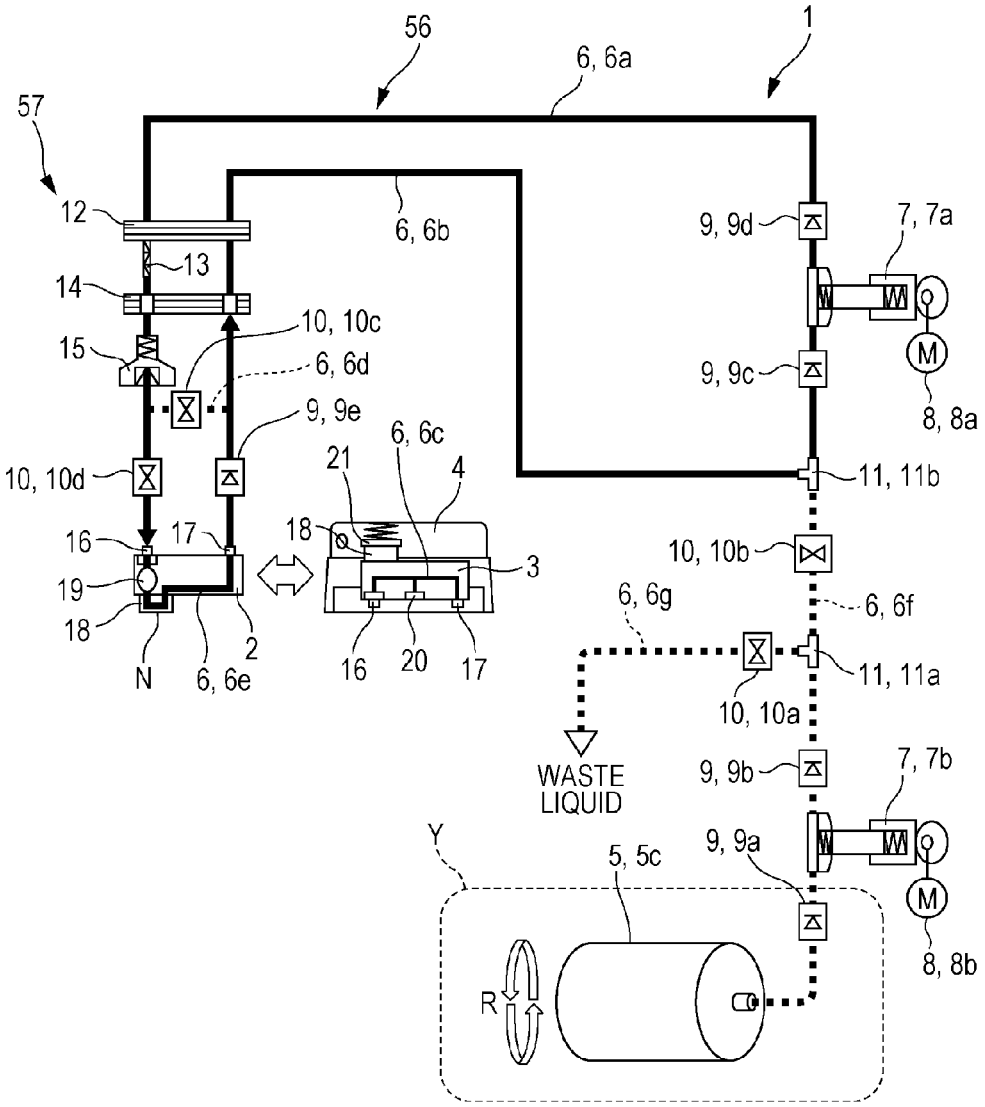
FIG. 8 is a schematic view illustrating the recording apparatus according to Embodiment 2 of the invention.

FIG. 8 is a schematic view illustrating the recording apparatus 1 according to the embodiment, and is a view corresponding to FIG. 1 in Embodiment 1 and FIG. 7 in Embodiment 2. The same reference numerals will be given to configuration members which are common to those in Embodiments 1 and 2 described above, and detailed description will be omitted.

The recording apparatus 1 according to the embodiment is different from the recording apparatus 1 according to Embodiment 1 and the recording apparatus 1 according to Embodiment 2 in only a configuration of a section illustrated by the reference numeral Y in FIG. 8.

The recording apparatus 1 according to the embodiment includes a bottle-shaped ink tank 5*c* as the liquid supply source 5. The ink tank 5*c* described herein rotates in a rotation direction R so as to stir the ink to be accommodated therein.

In Embodiments 1 to 3 described above, a filter 70 of the dummy head 3 is arranged between the gas-liquid separating unit 20 of the third route 6*c* and the connection portion 16 which can be connected to the supply port 30, that is, at a position closer to the connection portion 16 from the gas-liquid separating unit 20 (checkered portion in FIG. 4), but may be arranged at other positions in the third route 6*c*. For example, the filter 70 may be arranged between the gas-liquid separating unit 20 of the third route 6*c* and the connection portion 17 which can be connected to the collection port 31. Alternatively, the filter 70 may be arranged between the gas-liquid separating unit 20 and the connection portion 17, that is, at a position closer to the connection portion 17 from the gas-liquid separating unit 20.

In Embodiments 1 to 3 described above, the recording head (ink jet head) serving as a liquid ejecting unit has been described as an example. However, a basic configuration of the liquid ejecting unit is not limited to the above-described example. The invention widely aims at all liquid ejecting units. For example, the invention is also applicable to a color material ejecting head used in manufacturing color filters for liquid crystal displays, or an electrode material ejecting head used in forming electrodes for organic EL displays and field emission displays (FEDs).

The principle of driving the head is not limited to those which driven by a piezoelectric element, and is also applicable to a head using a thermal jet method.

The entire disclosure of Japanese Patent Application No. 2015-035021, filed Feb. 25, 2015 is expressly incorporated by reference herein.

What is claimed is:

1. A dummy head attachable to and detachable from an attachment/detachment position of a liquid ejecting head in a carriage of a liquid ejecting apparatus including the carriage which detachably holds a liquid ejecting head for ejecting a liquid onto a medium through a nozzle, a first route having a supply port through which the liquid can be supplied to the liquid ejecting head in a state of being attached to the carriage, and a second route having a collection port through which the liquid can be collected from the liquid ejecting head in the state of being attached to the carriage, the dummy head comprising:

a third route that can be connected to the supply port and the collection port.

2. The dummy head according to claim 1, wherein the third route includes a gas-liquid separating unit.

3. The dummy head according to claim 1, wherein the third route includes a filter.

4. The dummy head according to claim 1, wherein the liquid ejecting apparatus includes a cap which caps a forming portion of the nozzle in a state where the liquid ejecting head is attached to the carriage, and wherein the dummy head includes a contact portion which can come into contact with the cap in a state where the dummy head is attached to the carriage.

5. A liquid ejecting apparatus comprising:

a carriage that detachably holds a liquid ejecting head for ejecting a liquid onto a medium through a nozzle;

a first route that has a supply port through which the liquid to be accommodated in a liquid supply source can be supplied to the liquid ejecting head in a state of being attached to the carriage; and a second route that has a collection port through which the liquid can be collected from the liquid ejecting head in the state of being attached to the carriage, wherein in a state where the dummy head according to claim 1 is attached to the carriage, the liquid can be circulated in the first route, the second route, and the third route.

6. The liquid ejecting apparatus according to claim 5, further comprising:

a fourth route that connects the first route and the second route to each other, wherein when the liquid is ejected onto the medium by using the liquid ejecting head attached to the carriage, the liquid can be circulated in the first route, the second route, and the fourth route.

7. The liquid ejecting apparatus according to claim 6, wherein the liquid ejecting head disposed at multiple locations is attachable to and detachable from the carriage, wherein the first route and the second route are disposed for each of the multiple liquid ejecting heads, and wherein in a state where the liquid ejecting head and the dummy head are attached to the carriage, when the liquid is ejected onto the medium by using the liquid ejecting head attached to the carriage, the liquid can be circulated in the first route, the second route, and the third route which correspond to the dummy head attached to the carriage.

8. The liquid ejecting apparatus according to claim 5, wherein the liquid ejecting head disposed at multiple locations is attachable to and detachable from the carriage, wherein the first route and the second route are disposed for each of the multiple liquid ejecting heads, and wherein in a state where the liquid ejecting head and the dummy head are attached to the carriage, when the liquid is ejected onto the medium by using the liquid ejecting head attached to the carriage, the liquid can be circulated in the first route, the second route, and the third route which correspond to the dummy head attached to the carriage.

* * * * *